US008586489B2

(12) United States Patent
Shteiyer

(10) Patent No.: US 8,586,489 B2
(45) Date of Patent: Nov. 19, 2013

(54) WOVEN FABRIC

(75) Inventor: Yaakov Shteiyer, West Orange, NJ (US)

(73) Assignee: J.B. Martin Company Inc., New York, NY (US)

( * ) Notice: Subject to any disclaimer, the term of this patent is extended or adjusted under 35 U.S.C. 154(b) by 1097 days.

(21) Appl. No.: 12/562,827

(22) Filed: Sep. 18, 2009

(65) Prior Publication Data

US 2010/0075557 A1 Mar. 25, 2010

Related U.S. Application Data

(60) Provisional application No. 61/098,587, filed on Sep. 19, 2008.

(51) Int. Cl.
*D03D 11/00* (2006.01)

(52) U.S. Cl.
USPC ..... 442/206; 442/59; 442/181; 442/203

(58) Field of Classification Search
USPC ..... 442/181, 206, 203, 59
See application file for complete search history.

(56) References Cited

U.S. PATENT DOCUMENTS 3,991,551 A 11/1976 Petree
4,187,618 A * 2/1980 Diehl ..... 34/523
4,397,043 A 8/1983 Croteau
4,748,996 A 6/1988 Combier
4,782,534 A 11/1988 Grilliot et al.
4,821,780 A * 4/1989 Tate ..... 139/383 A
4,854,352 A 8/1989 Combier
4,922,969 A * 5/1990 Campman et al. ..... 139/408
4,923,741 A 5/1990 Kosmo et al.
4,967,419 A 11/1990 Elliott
5,069,957 A 12/1991 Vandermeersch
5,136,723 A 8/1992 Aldridge et al.

(Continued)

FOREIGN PATENT DOCUMENTS

DE 3519633 A1 12/1986
EP 0265550 A1 5/1988

(Continued)

OTHER PUBLICATIONS

R. Jeffries; Clothing for Work and Protection; Lenzinger Berichte; Aug. 1989; pp. 25-33; Book 67, British Textile Group, Manchester UK.

(Continued)

*Primary Examiner* — Peter Y Choi
*Assistant Examiner* — Vincent A Tatesure
(74) *Attorney, Agent, or Firm* — Alston & Bird LLP

(57) ABSTRACT

A woven fabric is provided that incorporates multiple systems of fibers into a unitary fabric and presents the fibers of only one of the warp systems on a first surface of the fabric. The fabric structure comprises first, second, and third warp systems that are interlaced with weft fibers such that, of the three warp systems, the first surface of the fabric comprises only the first warp system and thus "hides" the second and third warp systems, which are not interwoven with the fibers of the first warp system. In this way, the effect of the appearance of the second and third warp systems on the overall appearance of the fabric is reduced. The three warp systems may include fibers made of different materials to provide different characteristics to each layer of the fabric, or the warp systems may include fibers made of the same material.

11 Claims, 6 Drawing Sheets

(56) References Cited

U.S. PATENT DOCUMENTS

| | | | | |
|---|---|---|---|---|
| 5,207,753 | A | 5/1993 | Badrinath | |
| 5,527,597 | A | 6/1996 | Stanhope et al. | |
| 5,569,262 | A | 10/1996 | Carney | |
| 5,660,913 | A | 8/1997 | Coppage, Jr. | |
| 5,736,474 | A | 4/1998 | Thomas | |
| 5,887,453 | A | 3/1999 | Woods | |
| 5,899,241 | A | 5/1999 | David et al. | |
| 5,965,223 | A | 10/1999 | Andrews et al. | |
| 6,001,104 | A | 12/1999 | Benderev et al. | |
| 6,044,498 | A | 4/2000 | Schumann et al. | |
| 6,089,052 | A | 7/2000 | Riegger | |
| 6,526,862 | B1 | 3/2003 | Lyons | |
| 7,251,835 | B2 | 8/2007 | Learmont | |
| 2004/0206414 | A1 * | 10/2004 | Festor | 139/383 A |
| 2004/0266293 | A1 | 12/2004 | Thiriot | |
| 2005/0009429 | A1 | 1/2005 | Park et al. | |
| 2006/0015101 | A1 | 1/2006 | Warburton et al. | |
| 2007/0099528 | A1 | 5/2007 | Kolmes et al. | |

FOREIGN PATENT DOCUMENTS

| | | | |
|---|---|---|---|
| EP | 0724848 | A1 | 8/1996 |
| JP | 2002138309 | A | 5/2002 |
| WO | WO 95/26650 | | 10/1995 |
| WO | WO 2006/009504 | A1 | 1/2006 |

OTHER PUBLICATIONS

Heat of the Moment; Safety & Health Practitioner website; http://shpmags.com/article.asp?pagename=features&article_id=7098; Jan. 22, 2008; pp. 1-3.

Stefan Brzezinski, Grazyna Malinowska, Teresa Nowak; High-tech Sports Clothing With a High Comfort of Use Made from Multi-layer Composite Materials; Fibers & Textiles in Eastern Europe; Oct./Dec. 2005; pp. 90-93; vol. 13, No. 4(52); Institute of Textile Materials Engineering, Poland.

Vince; Fire Retardants: An Advantageous Solution to Fira Protection; Wisdom From the Professionals: A Collection of Articles on the Fabrics.net website; http://www.fabrics.net/FIREPROOFING.ASP; pp. 1-4; National Fireproofing Co.; Website last visited Dec. 17, 2009.

* cited by examiner

WOVEN FABRIC

CROSS-REFERENCE TO RELATED APPLICATIONS

The present application claims the benefit of U.S. Provisional Application No. 61/098,587, entitled "Woven Fabric," filed on Sep. 19, 2008, the contents of which are incorporated herein in their entirety.

BACKGROUND

As textile technology advances, consumers seek fabrics and clothing that are functional, comfortable, and affordable. For example, individuals who operate motorcycles and recreational vehicles may desire clothing that is both protective, to guard against cuts and abrasions in the case of a fall, and comfortable. A fabric that satisfies these requirements may thus need to include fabrics that are strong, soft, stretchable, and/or flexible.

Consumers may also desire protective clothing that is aesthetically stylish or at least non-obtrusive. For example, a person wearing protective pants for operating a motorcycle may not want to appear to be wearing protective clothing. Rather, such a person may prefer that the protective pants aesthetically mimic more conventional forms of clothing, such as denim blue jeans.

Applicant has discovered then that it would be desirable to provide a protective fabric that can be used to fashion clothing that is rugged, durable, comfortable, reliable, and/or attractive. As described in greater detail below, a variety of challenges were identified and overcome through Applicant's efforts to invent and develop such a fabric.

BRIEF SUMMARY OF THE INVENTION

Systems and methods are therefore provided for forming a fabric that incorporates multiple systems of fibers into a unitary fabric and presents the fibers of only one of the warp systems on a first surface of the fabric.

In some embodiments, a fabric having a first surface and a second surface is provided, in which the fabric includes a first warp system comprising first warp fibers, a second warp system comprising second warp fibers, a third warp system comprising third warp fibers, and a plurality of weft fibers. The first surface comprises first warp fibers of the first warp system and at least a portion of the plurality of weft fibers, and the second surface comprises second warp fibers of the second warp system and the third warp fibers of the third warp system.

In some cases, the first warp system may comprise first warp fibers selected from the group consisting of aesthetic fibers and performance fibers. The second warp system may comprise second warp fibers selected from the group consisting of performance fibers and stretchable fibers, and the third warp system may comprise third warp fibers that are comfort fibers. Furthermore, the weft fibers may comprise stretchable fibers.

The first warp fibers and the second warp fibers in some cases may be performance fibers. In other cases, the first warp fibers may be performance fibers, the second warp fibers may be stretchable fibers and the third warp fibers may be comfort fibers. In some cases, at least one of the first warp fibers, the second warp fibers, and the third warp fibers comprises stretchable fibers, and at least another of the first warp fibers, the second warp fibers, and the third warp fibers comprises fibers other than stretchable fibers.

The first surface may consist of first warp fibers of the first warp system and at least a portion of the plurality of weft fibers. The second surface may consist of second warp fibers of the second warp system and third warp fibers of the third warp system. Of the first, second, and third warp fibers, only the first warp fibers may be visible to a viewer when viewing the first surface. In addition, of the first, second, and third warp fibers, only the second and third warp fibers may be visible to the viewer when viewing the second surface.

In some embodiments, the plurality of weft fibers are arranged in first and second rows. First warp fibers of the first warp system may be interwoven with the weft fibers of the first row only, second warp fibers of the second warp system may be interwoven with the weft fibers of the first and second rows, and third warp fibers of the third warp system may be interwoven with the weft fibers of the second row only. The second warp fibers of the second warp system may be interwoven with the weft fibers of the first and second rows to form a lock weave structure. The first warp fibers of the first warp system may, in some cases, float at least two of the plurality of weft fibers, and the third warp fibers of the third warp system may float at least two of the plurality of weft fibers.

In other embodiments, a fabric having a first surface and a second surface is provided, where the fabric includes a first warp system, a second warp system, and a third warp system. The fabric further includes a first row of weft fibers and a second row of weft fibers, where the first warp system engages the first row of weft fibers, the third warp system engages the second row of weft fibers, and the second warp system engages the first row of weft fibers and the second row of weft fibers.

In some cases, the first warp system may comprise first warp fibers selected from the group consisting of aesthetic fibers and performance fibers. The second warp system may comprise second warp fibers selected from the group consisting of performance fibers and stretchable fibers, and the third warp system may comprise third warp fibers that are comfort fibers. Furthermore, the first row of weft fibers and the second row of weft fibers may comprise stretchable fibers.

The first warp system and the second warp system in some cases may comprise first warp fibers and second warp fibers, respectively, that are performance fibers. In other cases, the first warp system may comprise first warp fibers that are performance fibers, the second warp system may comprise second warp fibers that are stretchable fibers and the third warp system may comprise third warp fibers that are comfort fibers. In some cases, at least one of the first warp system, the second warp system, and the third warp system comprises stretchable fibers, and at least another of the first warp system, the second warp system, and the third warp system comprises fibers other than stretchable fibers.

Between approximately 60% and 70% of the first surface may be comprised of first warp fibers of the first warp system. In some cases, the first warp system may float at least two fibers of the first row of weft fibers, and the third warp system may float at least two fibers of the second row of weft fibers. Additionally, the second warp system may engage the first row of weft fibers and the second row of weft fibers to form a lock weave structure.

In still other embodiments, a method of weaving a fabric is provided, in which a first warp system, a second warp system, a third warp system, a first row of weft fibers, and a second row of weft fibers are provided. First warp fibers of the first warp system are interwoven with the first row of weft fibers, and second warp fibers of the second warp system are interwoven with the first row of weft fibers and the second row of weft fibers. In addition, third warp fibers of the third warp system are interwoven with the second row of weft fibers.

In some cases, interweaving the first warp fibers of the first warp system with the first row of weft fibers comprises interweaving first warp fibers selected from the group consisting of aesthetic fibers and performance fibers with the first row of weft fibers. In addition, interweaving the second warp fibers of the second warp system with the first row of weft fibers and the second row of weft fibers may comprise interweaving second warp fibers selected from the group consisting of performance fibers and stretchable fibers with the first row of weft fibers and the second row of weft fibers. Furthermore, interweaving the third warp fibers of the third warp system with the second row of weft fibers comprises interweaving third warp fibers that are comfort fibers with the second row of weft fibers.

In some embodiments, the first row of weft fibers and the second row of weft fibers may comprise stretchable fibers. In other embodiments, the first warp fibers and the second warp fibers are performance fibers. In addition, the first warp fibers may be performance fibers, the second warp fibers may be stretchable fibers, and the third warp fibers may be comfort fibers. Furthermore, at least one of the first warp fibers, the second warp fibers, and the third warp fibers may comprise stretchable fibers, and at least another of the first warp fibers, the second warp fibers, and the third warp fibers may comprise fibers other than stretchable fibers In some cases, interweaving the first warp fibers of the first warp system with the first row of weft fibers comprises floating at least two fibers of the first row of weft fibers. In addition, interweaving the fibers of the third warp system with the second row of weft fibers may comprise floating at least two fibers of the second row of weft fibers. Furthermore, interweaving the second warp fibers of the second warp system with the first row of weft fibers and the second row of weft fibers may comprise forming a lock weave structure.

As described in greater detail below, embodiments of the present invention are thus directed to providing a fabric that is structured to use and combine multiple fibers that are each selected to provide the fabric with specific qualities, characteristics, and/or functions.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION

Figure 1:
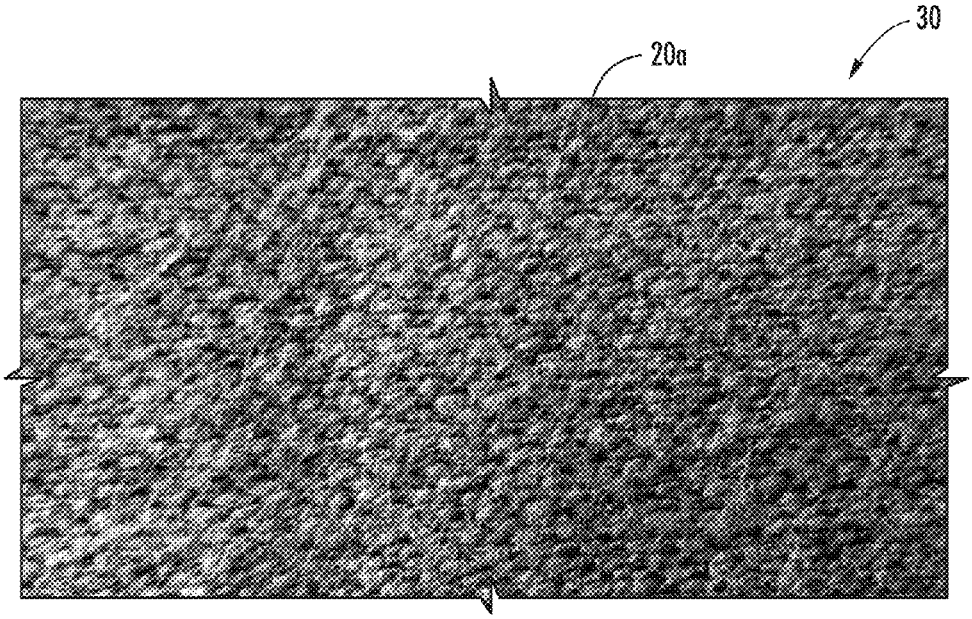
FIG. 1 depicts a first surface of a fabric structured in accordance with one exemplary embodiment of the present invention.

Embodiments of the present invention now will be described more fully hereinafter with reference to the accompanying drawings, in which some, but not all, embodiments of the invention are shown. Indeed, embodiments of the invention may be in many different forms and should not be construed as limited to the embodiments set forth herein; rather, these embodiments are provided so that this disclosure will satisfy applicable legal requirements. Like reference numerals refer to like elements throughout.

Various embodiments of the present invention are directed to a fabric that is structured to use and combine multiple fibers each selected to provide the fabric with specific qualities, characteristics, and/or functions. For example, fabrics structured in accordance with the present invention may include fibers selected to impart strength, durability, abrasion and/or cut resistance, fire resistance, and/or ballistic protection to the fabric. Other fibers may be selected to impart comfort, breatheability, drapeability, and/or stretch to the fabric. Still other fibers may be selected to improve the fabric's aesthetic appearance.

In developing fabrics comprised of multiple fibers as discussed above, Applicant discovered that by using a first fiber selected to provide a first quality (e.g., abrasion resistance), Applicant may inherently be undermining another desired quality (e.g., comfort or aesthetic appeal). For example, by using high molecular weight polyethylene fibers for their high strength and tenacity, Applicant may necessarily be introducing a fiber to the fabric that has poor dye acceptance and drapeability. As discussed in greater detail below, various embodiments of the present invention are structured to limit such counter-productive effects.

The foregoing specification refers for illustration purposes to various textile related terms. For example, the terms "warp" and "weft" are used when describing woven fabrics structured in accordance with various embodiments of the present invention. The term "warp" refers to fibers or yarns that run in the lengthwise or machine direction of the fabric. The term "weft" refers to the fill fibers or yarns that run in a crosswise direction that is transverse to the machine direction of the fabric. Individual weft fibers may be referred to herein as "picks." A collection of warp fibers having the same weave structure or configuration is referred to herein as a warp system. As illustrated and described below with reference to FIGS. 3 and 4, warp fibers may be classified as having the same weave structure (and thus part of the same warp system) in situations where the weave structure is shifted with respect to adjacent fibers. The term "fiber" is used throughout the spec to denote a component of the fabric that is interwoven with other components to form the fabric. For example, fibers can include monofilament fibers, multifilament fibers, threads, yarns, staple fibers, composite fibers, and so on.

Figure 3:
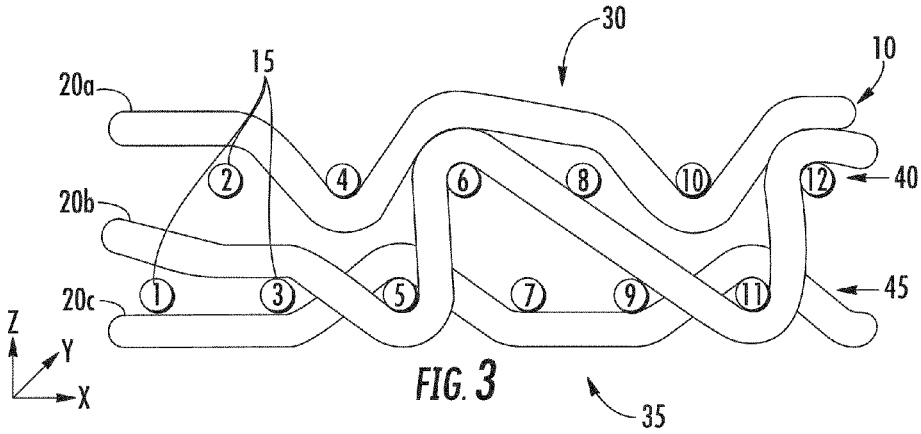
FIG. 3 is a schematic representation of a detail, cross-sectional view taken in a warp or machine direction of the fabric along line 3-3 of FIG. 1A.
Figure 4:
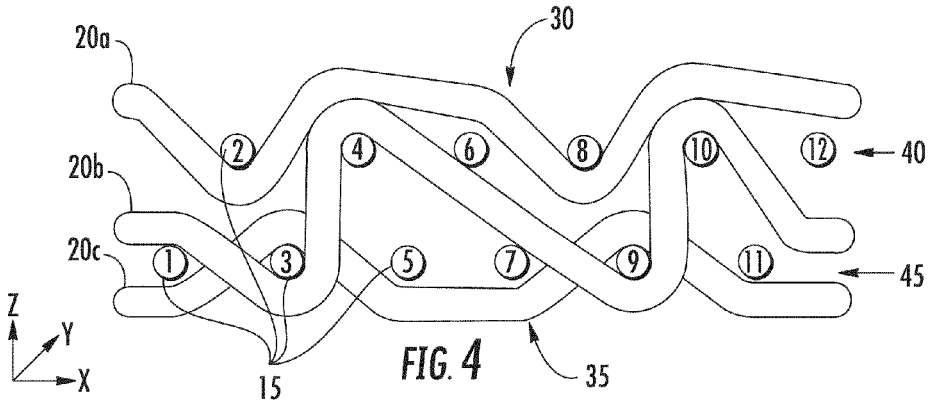
FIG. 4 is a schematic representation of a detail, cross-sectional view taken in a warp or machine direction of the fabric along line 4-4 of FIG. 1A.

FIGS. 1, 1A, 1B, 2, 2A, and 2B depict a first surface 30 and a second surface 35 of the woven fabric 10 according to an exemplary embodiment. For purposes of explanation, reference axes are provided on FIGS. 1, 1A, 1B, 2, 2A, and 2B, with the warp fibers extending along the x-axis and the weft fibers extending along the y-axis. The z-axis in FIGS. 1, 1A, 2, and 2A, extends out of the page. FIG. 3 illustrates a warpwise cross-section of the fabric 10 taken along line 3-3 of FIG. 1B, or in the x-z plane, and FIG. 4 illustrates a warpwise cross-section of the fabric taken along line 4-4 of FIG. 1B. Thus, in FIGS. 3 and 4, the y-axis extends into the page.

In an exemplary embodiment, the depicted woven portion of fabric 10 includes 12 weft fibers 15 and three warp systems 20*a*, 20*b*, 20*c*. As described in greater detail below, the fibers of the three warp systems 20*a*, 20*b*, and 20*c* (which may be referred to as first warp fibers of the first warp system 20*a*, second warp fibers of the second warp system 20*b*, and third warp fibers of the third warp system 20*c*) and the weft fibers 15 may be interwoven in accordance with embodiments of the present invention such that, of the three warp systems, the first surface 30 of the resulting fabric 10 (FIGS. 1 and 1A) comprises only fibers of the first warp system 20*a*. Thus, Applicant has discovered that in forming a fabric having the structure described below, the fibers of the second and third warp systems 20*b*, 20*c* can be "hidden" by the fibers of the first warp system 20*a* and, thus, any negative effects (e.g., aesthetic appearance, texture, drapeability characteristics, etc.) associated with the second and third warp systems 20*b*, 20*c* may be significantly reduced.

With reference to FIG. 3, in the depicted fabric 10 portion, 12 weft fibers 15 are arranged in two rows 40, 45, with 6 weft fibers in each row. The 12 weft fibers have been sequentially numbered for illustration purposes and are referred to herein as "pick 1," "pick 2," "pick 3," and so on. Although the figures depict the diameters of the warp systems and the weft fibers to be similar, the diameters of the fibers may be the same or different and are not limited to the schematic representation provided in the figures. For example, the fibers of one or more warp system may have a larger diameter than the weft fibers, or vice versa. In addition, although the figures depict a single fiber for each of the three warp systems 20*a*, 20*b*, and 20*c*, one or more of the warp systems may include multiple fibers. For example, in one embodiment (not shown), the third warp system 20*c* may comprise two fibers (e.g., in parallel, twisted, wrapped, etc.) that are interwoven with the weft fibers in the same manner as described in greater detail below with respect to the figures.

In the depicted embodiment, the first warp system 20*a* is structured to pass over two weft fibers (picks 6 and 8) and under one weft fiber (pick 4) in a configuration that may be repeated throughout the fabric. The fibers of the first warp system 20*a* are thus configured to weave together or engage with fibers of the first row of weft fibers 40. This "two float" structure could be replaced with a three float structure (i.e., the first warp system passes over three picks before proceeding under one) or other weave structures having still greater numbers of floats depending upon fabric design requirements as will be understood by one of ordinary skill in the art in light of this disclosure.

In another aspect of the depicted embodiment, the fibers of the second warp system 20*b* are structured to weave together or engage first and second rows 40, 45 of weft fibers. For example, the second warp system 20*b* is structured to float picks 1 and 3, loop under pick 5, and loop over pick 6, with the interweaving of the second warp system with picks 5 and 6 forming a lock weave that is intended to tie together the first and second rows 40 and 45. This structure is then repeated such that the second warp system 20*b* floats picks 7 and 9, loops under pick 11, and loops over pick 12, forming a second lock weave around picks 11 and 12. As will be apparent to one of ordinary skill in the art, this weave structure may be repeated throughout the fabric to tie together the first and second rows 40 and 45 without exposing fibers of the second warp system 20*b* to a viewer facing surface 30. For example, the weave structure may be used to isolate certain fibers from the surface 30 where the isolated fibers exhibit poor aesthetic characteristics (e.g., if the surface 30 is the outer surface of a garment) or if the isolated fibers exhibit poor comfort characteristics (e.g., if the surface 30 is the inner surface of a garment that is near or in contact with the wearer's skin), or for various other reasons.

In still another aspect of the depicted embodiment, the fibers of the third warp system 20*c* are structured similarly to the fibers of the first warp system 20*a*, except that their position is inverted relative to the weft fibers and they are woven with or engage the weft fibers of the second row 45 rather than the first row 40. More specifically, the fibers of the third warp system 20*c* are structured to float picks 1 and 3 and loop over pick 5. This structure is then repeated as the fibers of the third warp system 20*c* also float picks 7 and 9 and loop over pick 11. In this way, fibers of the third warp system 20*c* are only visible on the second surface 35 of the fabric 10.

The repeated weave structure of the three warp systems 20*a*, 20*b*, 20*c* may be shifted in the warp direction (along the x-axis direction), for example, when cross-sections taken at different weftwise positions (positions along the y-axis) of the fabric are compared. For instance, FIG. 3 illustrates a warpwise cross-section of the fabric 10 taken at a first weftwise position along line 3-3 of FIG. 1B, while FIG. 4 illustrates a warpwise cross-section of the fabric 10 taken at a second weftwise position along line 4-4 of FIG. 1B. In this example, the cross-section shown in FIG. 4 is taken along a warp fiber of the first warp system 20*a* that is adjacent the warp fiber along which the cross-section in FIG. 3 is taken. FIG. 4 thus shows a similar repeated weave structure of the three warp systems 20*a*, 20*b*, 20*c*, except that in FIG. 4, the repeated weave structure is shifted to the left by one pick. As a result, the fibers of the first warp system 20*a* are integrated into the fabric without interweaving the fibers of the second and/or third warp systems 20*b*, 20*c* with the fibers of the first warp system 20*a*.

As noted above, although the depicted warp systems include two floats, various embodiments of the present invention are not limited to exclusively incorporating two float structures. For example, in other embodiments, warp systems having three or more floats may be used to provide greater flexibility, stretch, and/or drapeability to the fabric. Furthermore, in some embodiments, different warp systems may have a different number of floats. For example, the first warp system may have two floats, whereas the second and/or third warp systems may have three or more floats.

In yet another aspect of the depicted embodiment, the structure of the fabric 10 defines a first surface 30 and a second surface 35 that collectively lend themselves to aesthetic, comfort, or other customization. For example, were the depicted fabric to be made into an article of clothing, the first surface 30 may correspond to an "outer" surface of the fabric 10 that is intended to be seen by viewers when the article of clothing is being worn by a wearer. The second surface 35 may then correspond to an "inner" surface of the fabric 10 that is intended to be worn on the inside of the clothing, perhaps against a wearer's skin.

In the depicted embodiment, the first surface 30 of the fabric 10 includes only the fibers of the first warp system 20*a* and certain weft fibers (e.g., the weft fibers of the first row 40). All other weft fibers and the fibers of the second and third warp systems 20*b*, 20*c* remain hidden from a viewer looking at the first or outer surface 30. As will be apparent to one of ordinary skill in the art, the fibers selected for use in the first warp system 20*a*, and optionally those of the weft fibers of the first row 40, may be specifically selected for their aesthetic appeal. For example, fibers that are particularly suited to receive dyes may be used to create a colorful external fabric appearance.

Figure 1A:
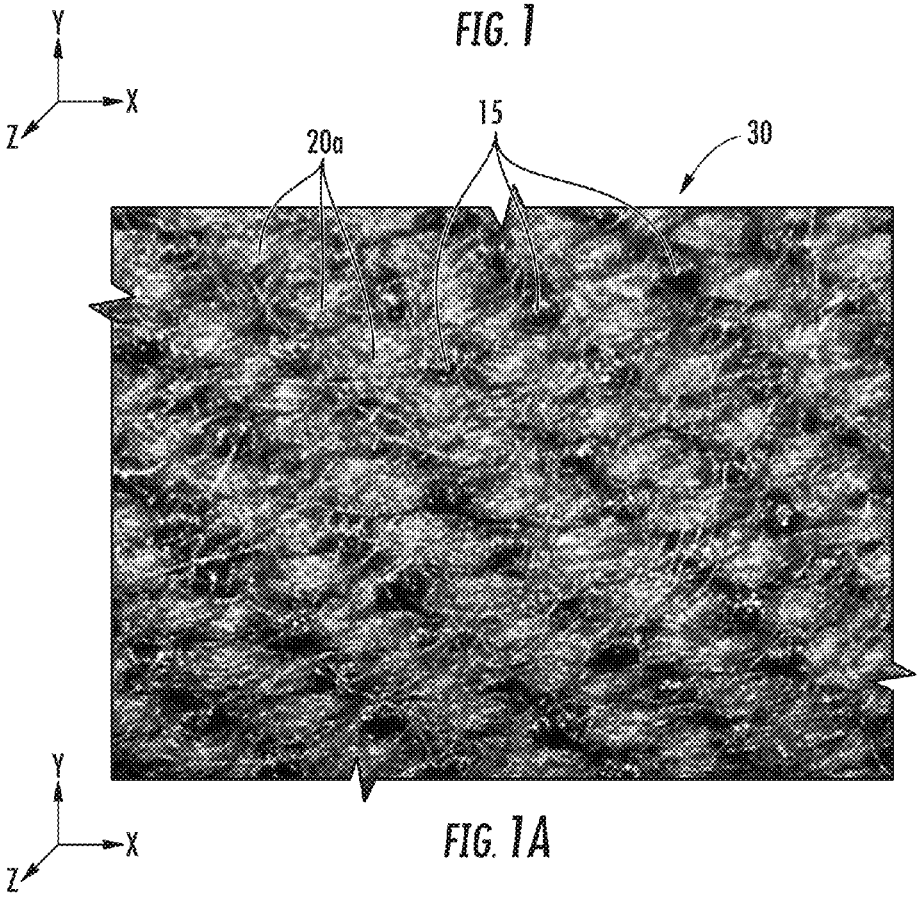
FIG. 1A depicts a detail view of the first surface of the fabric of FIG. 1.
Figure 1B:
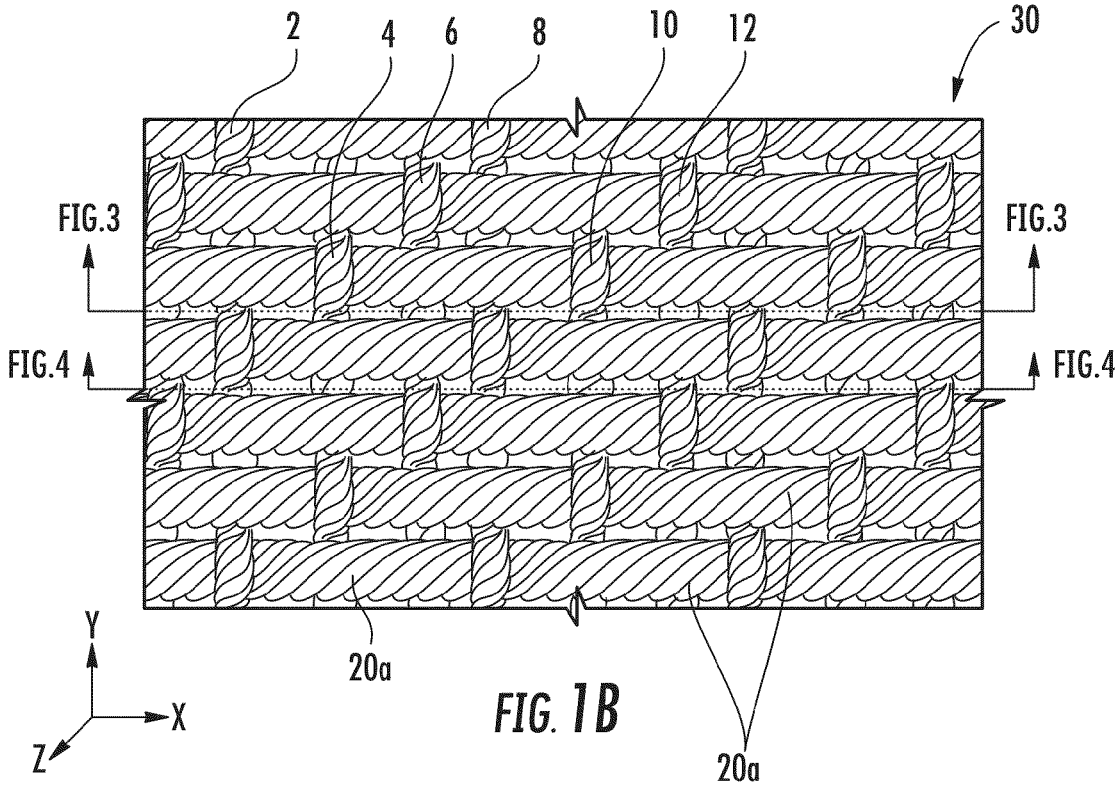
FIG. 1B is a schematic representation of the detail view of FIG. 1A.

In one embodiment, the first surface 30 is comprised substantially of fibers from the first warp system 20*a*, as shown in FIGS. 1, 1A, and 1B. More particularly, depending upon the relative diameter of the weft fibers of the first row 40, first warp fibers of the first warp system 20*a* may comprise between approximately 60% and 70% of the visible surface of the first surface 30. For example, approximately 66% of the first surface 30 may be comprised of first warp fibers of the first warp system 20*a*. In other words, of every three weft fibers in the first row 40 the first warp system floats two and exposes one. As will be apparent to one of skill in the art in view of this disclosure, the relative percentage of first warp system's 20*a* coverage of the first surface 30 may be increased by increasing the number of first warp system floats.

Figure 2:
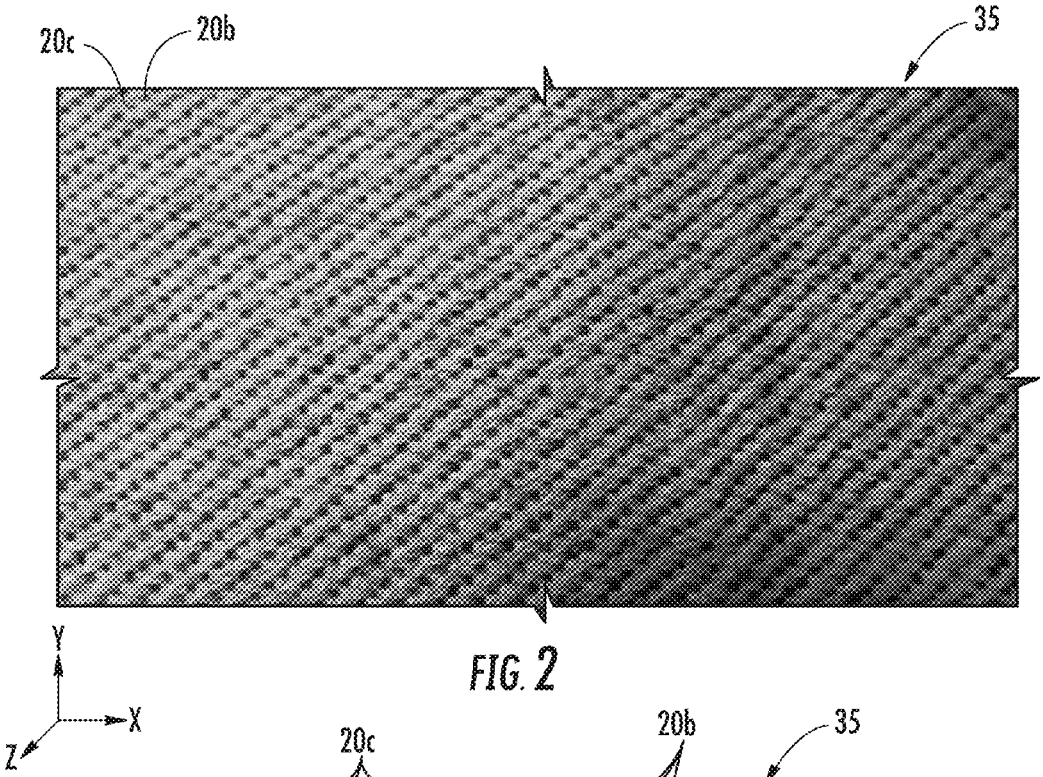
FIG. 2 depicts a second surface of the fabric of FIG. 1.
Figure 2A:
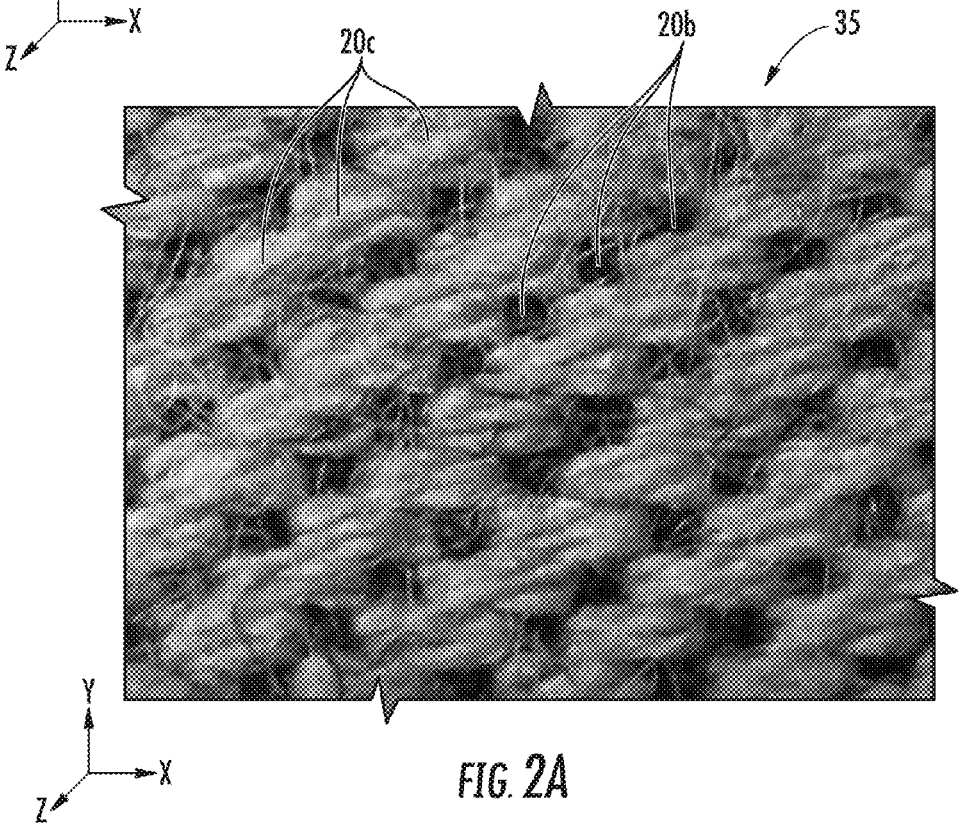
FIG. 2A depicts a detail view of the second surface of the fabric of FIG. 2.
Figure 2B:
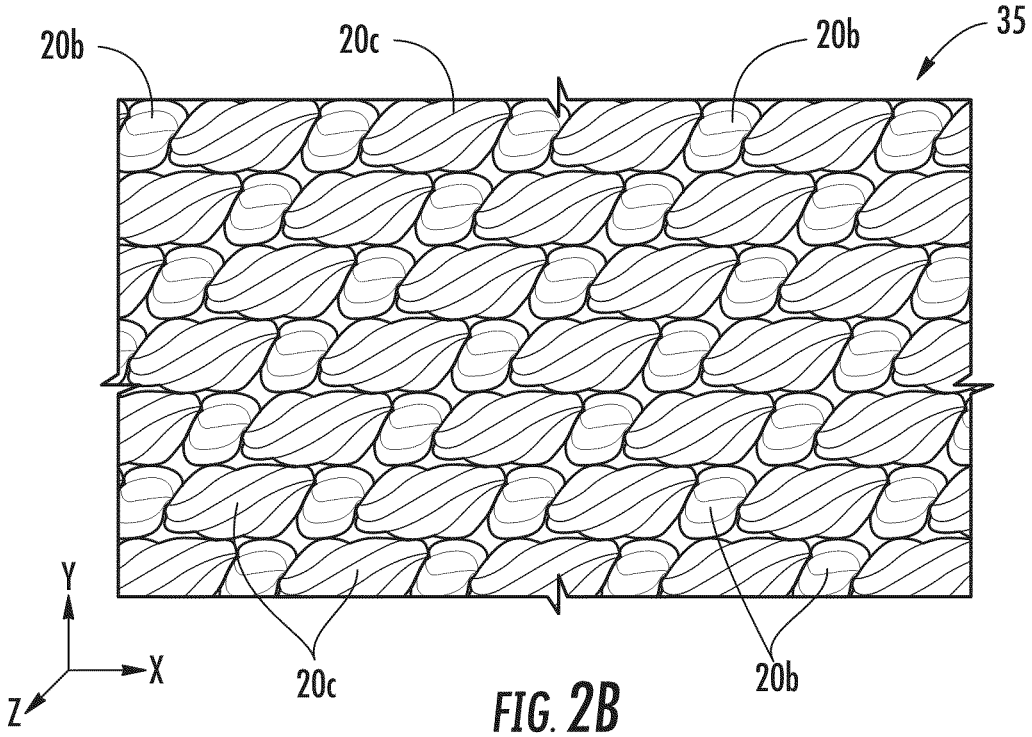
FIG. 2B is a schematic representation of the detail view of FIG. 2A.

The second surface 35 of the depicted fabric 10 comprises only fibers of the second and third warp systems 20*b*, 20*c*, as shown in FIGS. 2, 2A, and 2B. All weft fibers and fibers of the first warp system 20*a* are hidden from a viewer looking at the second surface 35. Said differently, such fibers may be isolated from a wearer's skin when the skin is presented against the second or "inner" surface 35.

In one embodiment, the second or inner surface 35 is comprised substantially of fibers from the third warp system 20*c*. More particularly, depending upon the relative diameter of the weft fibers of second row 45, fibers of the third warp system 20*c* may comprise between approximately 60% and 70% of the visible surface of the second surface 35 (such as approximately 66%). In other words, of every three weft fibers in the second row 45 the third warp system floats two weft fibers and exposes a portion of the second warp system 20*b* that encapsulates one weft fiber. As will be apparent to one of skill in the art in view of this disclosure, the relative percentage of third warp system's 20*c* coverage of the second surface 35 may be increased by increasing the number of third warp system floats.

In one embodiment of the present invention, the first warp fibers of the first warp system 20*a* may be aesthetic fibers that are selected for their aesthetic appeal (e.g., color, texture, ability to receive dye, drapeability, etc.). Examples of such fibers may include natural fibers, cotton, wool, rayon, polyamid fibers, modeacrylic fibers, high modulus fibers, Kevlar® fibers, Nomex® fibers, and other fibers formulated to produce or exhibit aesthetic characteristics.

The second warp fibers of the second warp system 20*b* may be performance fibers that are selected for their strength or protective properties (e.g., cut, abrasion, ballistic, and/or fire resistance characteristics, etc.). Examples of performance fibers include high molecular weight polyethylene, aramid, carbon fiber, Kevlar® fibers, Nomex® fibers, fiberglass, and other fibers formulated to produce or exhibit performance characteristics. Many performance fibers are not aesthetically desirable (e.g., don't receive dyes or colors well, etc.); however, by structuring a fabric in accordance with various embodiments of the present invention, traditional aesthetic problems associated with such fibers may have a significantly reduced effect given that such fibers are generally hidden from view as part of the second warp system 20*b*.

The third warp fibers of the third warp system 20*c* may be comfort fibers that are selected for their comfort-providing qualities (e.g., softness against a wearer's skin, cooling properties, etc.). Examples of comfort fibers include cellulosic fibers such as cotton, rayon, wool, microfiber polyester, nylon, and other fibers formulated to produce or exhibit comfort characteristics.

In addition, the weft fibers may be stretchable fibers that are selected to provide flexibility to the fabric to allow the fabric to have a better fit on the wearer and to allow the wearer more unrestricted movement while wearing the fabric. Examples of stretchable fibers include Lycra® fibers, Spandex® fibers, composite fibers that include Lycra® or Spandex® fibers, Kevlar® fibers, high modulus polyethylene, wool, rayon, nylon, modeacrylic fibers, and other fibers formulated to exhibit stretch characteristics.

In some embodiments, one or more warp system fibers may include a stretchable fiber to provide flexibility to the fabric. For example, the second warp system 20*b* may include Lycra® fibers, and the fibers of the other two warp systems 20*a*, 20*c* may include fibers other than stretchable fibers. The fibers of the three warp systems may be interwoven in such a way that when the Lycra® fibers of the second warp system 20*b* in this example are in a relaxed state (e.g., not stretched), the fibers of the other two warp systems are not at their full length but rather include some "slack." In this way, when the fabric is stretched in the warp direction and the stretchable warp system fibers are stretched, the fibers of the other two warp systems may be able to provide some flexibility as they extend to their full length to remove the "built-in slack."

In still other embodiments of the present invention, the fibers of each of the warp systems 20*a*, 20*b*, 20*c* and the weft fibers 15 may be chosen to perform certain functions within the fabric based on their position in the structure of the fabric and their relative visibility in the resulting garment. In other words, because the fibers of the second and third warp systems 20*b*, 20*c* and the weft fibers 15 of the second row 45 are hidden by the fibers of the first warp system 20*a* when the first surface 30 of the fabric 10 is viewed, the second and third warp systems 20*b*, 20*c* and the weft fibers 15 of the second row 45 may be chosen with less regard to their relative aesthetic appeal. Rather, the appearance of the fabric 10 and resulting garment will be generally based on the appearance and aesthetic qualities of the first warp system 20*a* and, to a lesser extent, the first row 40 of weft fibers 15.

In one exemplary embodiment, a piece dye or yarn dye fabric intended to be cut- and abrasion-resistant and/or flame and water resistant, as well as comfortable, flexible, stretchable, and also aesthetically-pleasing may be comprised as follows. A modeacrylic fiber may be selected for the first warp system 20*a* due to its dye-receiving capacity and/or overall aesthetic appeal. High molecular weight polyethylene fibers, such as Spectra® fibers produced by Honeywell or Dyneema® fibers produced by DSM, may be selected as the fibers of the second warp system 20*b*. Such high molecular weight polyethylene fibers are typically light-weight and exhibit very good strength characteristics and, as such, are useful for making various types of abrasion-resistant and protective clothing. As was noted above, high molecular weight fibers are generally more difficult to dye and, thus, are desirably hidden from view. Cellulosic fibers, such as cotton fibers, may be selected as the fibers of the third warp system 20*c* to provide comfort to the wearer in the form of softness and breathability of the fabric. The weft fibers of this exemplary embodiment are comprised of nylon or Lycra® fibers, or a nylon-Lycra® fiber blend. Such fibers provide added stretch properties and flexibility that may improve the fit and comfort of any article of clothing produced with the exemplary fabric. Any material, however, may be used in any combination to form the fibers of one or more of the warp systems and/or one or more of the weft fibers.

As will be apparent to one of skill in the art upon reviewing this disclosure, fabrics configured in accordance with various embodiments of the present invention may be structured to provide more aesthetically pleasing, comfortable, and functional fabrics as one surface of the fabric (e.g., the outer surface) may be woven to disguise some of the other fibers that comprise the fabric. In this way, fibers that may be difficult to dye or may otherwise detract from the appearance of the fabric may be used but desirably hidden from view. The layers of the fabric can be customized to provide the desired performance characteristics by choosing the appropriate material for each of the warp systems and the various weft fibers. Thus, each of the first warp system, the second warp system, and the third warp system may include fibers made of a material that is different from the fibers of at least one other of the first, second, and third warp systems. Alternatively, however, the same material can be used for the fibers of two or more warp systems and/or the weft fibers to provide multiple layers that exhibit the same or similar performance characteristics, if so desired. For example, performance fibers may be selected for two or more of the warp systems 20*a*, 20*b*, 20*c* in order to provide a multi-layer fabric that is more durable and/or more resistant to cuts, abrasion, and/or fire than a multi-layer fabric in which only one of the warp systems includes performance fibers.

Figure 5:
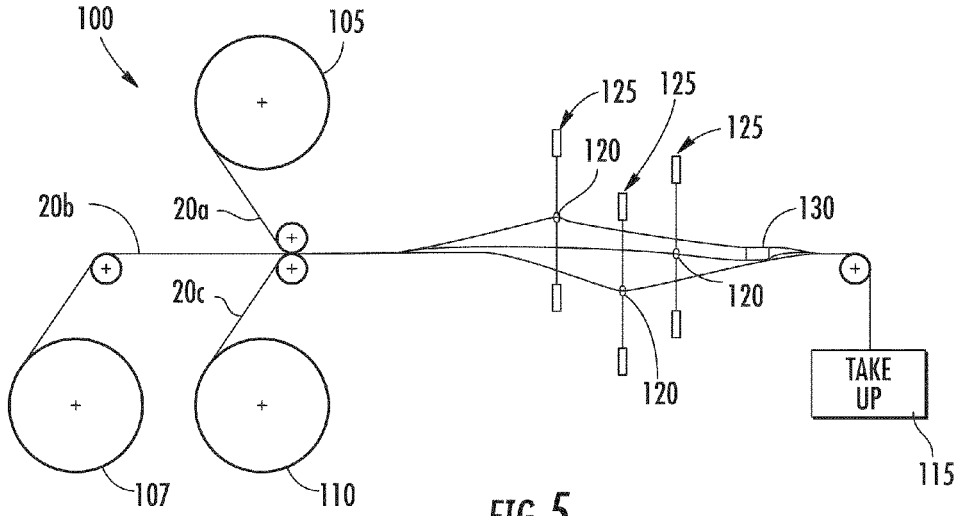
FIG. 5 is a schematic representation of a loom for weaving fabrics in accordance with one exemplary embodiment of the present invention.

The fabric structure 10 described above can be formed using an apparatus such as the loom 100 shown in FIG. 5. The loom 100 includes a first beam 105 holding a supply of warp fibers, such as fibers of the first warp system 20*a*, a second beam 107 holding, for example, fibers of the second warp system 20*b*, and a third beam 110 holding, for example, fibers of the third warp system 20*c*. The first, second, and third beams 105, 107, 110 may be positively driven to advance the warp fibers through the loom 100 to a fabric take-up area 115. As will be apparent to one of skill in the art in view of this disclosure, the warp systems are fed through heddles 120, each heddle 120 being supported by a frame 125. One or more grippers 130 are used to pull the weft picks through the shed that is created by the movement of the frames 125 and heddles 120. As will be further appreciated by one of ordinary skill in the art, the loom 100 may include hundreds of beams and frames to provide for the weaving of large portions of fabric. Thus, FIG. 5 provides a very simplified illustration for the purposes of explanation, only.

Figure 6:
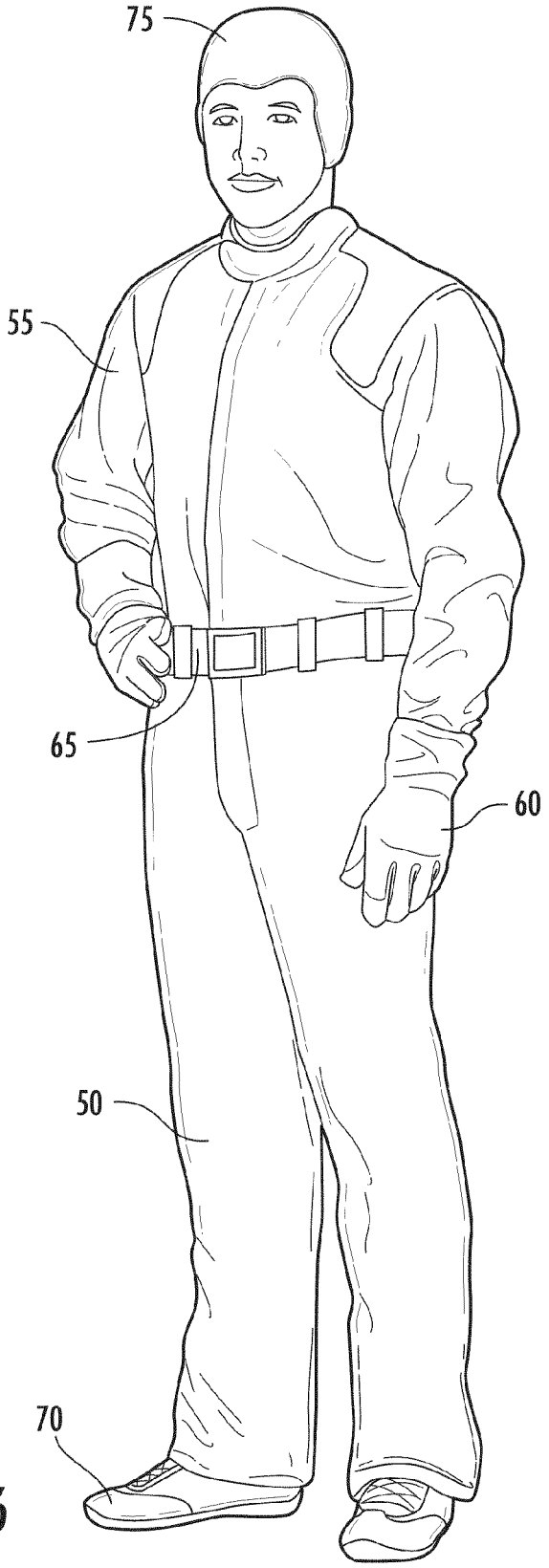
FIG. 6 illustrates clothing made from fabric woven in accordance with one exemplary embodiment of the present invention.

FIG. 6 illustrates an example of different types of clothing that may be fashioned from embodiments of the fabric of the present invention. For example, the fabric can be used to fashion pants 50, overcoats 55 or shirts, gloves 60, belts 65, socks and footwear 70, and hats 75, among many other forms of clothing. Although the example above describes the selection of modeacrylic fibers, high molecular weight polyethylene fibers, cotton, and nylon/Lycra® fibers for the fibers of the first, second, and third warp systems and the weft fibers, respectively, various types of fibers can be used to impart different characteristics to the fabric. As mentioned above, the different fibers that may be used may include aramids (such as Nomex® fibers), para-aramid synthetic fibers (such as Kevlar® fibers), carbon fibers, ceramic fibers, metallic fibers, wire, polyester, rayon, nylon, cotton, polypropylene, polyethylene, and so on.

Depending on the choice of fibers for weaving the fabric, the fabric may be optimized for particular applications and may exhibit desirable chemical, electrical, thermal, mechanical, and/or physical properties as needed. As such, the fabric can be used to form clothing for various purposes, such as protective clothing for motorcycle operators and construction workers, flame-resistant clothing for fire fighters, armored clothing for law enforcement and military personnel, and other types of clothing that may be designed to protect the wearer from one or more particular environmental conditions.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A fabric having a first surface and a second surface, the fabric comprising:

a first warp system;

a second warp system;

a third warp system;

a first row of weft fibers; and a second row of weft fibers, wherein the first warp system engages the first row of weft fibers, wherein the third warp system engages the second row of weft fibers, and wherein the second warp system engages the first row of weft fibers and the second row of weft fibers to form a lock weave structure, wherein the lock weave structure comprises looping under a first weft fiber of the second row and looping over a second weft fiber of the first row, the first weft fiber being next to the second weft fiber, wherein the first surface comprises first warp fibers of the first warp system and at least a portion of the plurality of weft fibers, and wherein the second surface consists of second warp fibers of the second warp system and third warp fibers of the third warp system such that the first surface corresponds to an outer surface of a garment made from the fabric and the second surface corresponds to an inner surface of a garment made from the fabric, where the inner surface is configured to be worn closer to a wearer's skin than the outer surface.

2. The fabric of claim 1, wherein the first warp system comprises first warp fibers selected from the group consisting of natural fibers, cotton, wool, rayon, polyamide fibers, modeacrylic fibers, high modulus fibers, para-aramid fibers, flame-resistant meta-aramid fibers, high molecular weight polyethylene, aramid, carbon fiber, fiberglass, such that the first warp fibers are aesthetic fibers or performance fibers.

3. The fabric of claim 1, wherein the second warp system comprises second warp fibers selected from the group consisting of high molecular weight polyethylene, aramid, carbon fiber, para-aramid fibers, flame-resistant meta-aramid fibers, fiberglass, elastane fibers, spandex fibers, composite fibers including elastane fibers and spandex fibers, high modulus polyethylene, wool, rayon, nylon, modeacrylic fibers, such that the second warp fibers are performance fibers or stretchable fibers.

4. The fabric of claim 1, wherein the third warp system comprises third warp fibers selected from the group consisting of cotton, rayon, wool, microfiber polyester, nylon, and cellulosic fibers, such that the third warp fibers are comfort fibers.

5. The fabric of claim 1, wherein the first row of weft fibers and the second row of weft fibers comprise stretchable fibers.

6. The fabric of claim 1, wherein the first warp system and the second warp system comprise first warp fibers and second warp fibers, respectively, wherein the first warp fibers and the second warp fibers are selected from the group consisting of high molecular weight polyethylene, aramid, carbon fiber, para-aramid fibers, flame-resistant meta-aramid fibers, and fiberglass, such that the first warp fibers and the second warp fibers are performance fibers.

7. The fabric of claim 1, wherein the first warp system comprises first warp fibers selected from the group consisting of high molecular weight polyethylene, aramid, carbon fiber, para-aramid fibers, flame-resistant meta-aramid fibers, and fiberglass, such that the first warp fibers are performance fibers; wherein the second warp system comprises second warp fibers that are stretchable fibers; and wherein the third warp system comprises third warp fibers selected from the group consisting of cotton, rayon, wool, microfiber polyester, nylon, and cellulosic fibers, such that the third warp fibers are comfort fibers.

8. The fabric of claim 1, wherein at least one of the first warp system, the second warp system, and the third warp system comprises stretchable fibers, and wherein at least another of the first warp system, the second warp system, and the third warp system comprises fibers other than stretchable fibers.

9. The fabric of claim 1, wherein between approximately 60% and 70% of the first surface is comprised of first warp fibers of the first warp system.

10. The fabric of claim 1, wherein the first warp system floats at least two fibers of the first row of weft fibers.

11. The fabric of claim 10, wherein the third warp system floats at least two fibers of the second row of weft fibers.

* * * * *